US007458457B2

(12) United States Patent
Hiller et al.

(10) Patent No.: US 7,458,457 B2
(45) Date of Patent: Dec. 2, 2008

(54) JEWELRY HOLDER

(76) Inventors: Diane E. Hiller, 5712 N. 18th Rd., Arlington, VA (US) 22205; Sydney Hiller, 5712 N. 18th Rd., Arlington, VA (US) 22205

( * ) Notice: Subject to any disclaimer, the term of this patent is extended or adjusted under 35 U.S.C. 154(b) by 739 days.

(21) Appl. No.: 11/018,754

(22) Filed: Dec. 22, 2004

(65) Prior Publication Data

US 2006/0131187 A1 Jun. 22, 2006

(51) Int. Cl.
*A45C 11/04* (2006.01)

(52) U.S. Cl. ..... 206/6.1; 294/158; 294/170

(58) Field of Classification Search ..... 206/6.1, 206/566; 294/158, 170, 137, 146
See application file for complete search history.

(56) References Cited

U.S. PATENT DOCUMENTS 2,956,831 A * 10/1960 Duppengiesser ..... 294/57
3,374,025 A * 3/1968 Mantelet ..... 294/99.2
3,583,750 A * 6/1971 Norton ..... 294/74
4,003,216 A 1/1977 Cecere et al.
4,056,951 A 11/1977 Black
4,129,998 A 12/1978 Ferro
4,195,492 A 4/1980 Johnson
4,264,013 A 4/1981 Vollmer
4,382,317 A 5/1983 McDonald et al.
4,528,729 A * 7/1985 Schmidt et al. ..... 24/599.4
4,720,012 A 1/1988 Dufour
4,905,821 A 3/1990 Corbett
5,096,169 A 3/1992 Behnke
5,146,768 A 9/1992 Dichtel
5,240,120 A 8/1993 McDonough
5,456,094 A 10/1995 Greenwald
5,504,664 A 4/1996 Ostema
5,511,873 A 4/1996 Mech
5,704,671 A * 1/1998 van der Wal et al. ..... 294/31.2
5,743,113 A 4/1998 Kogen
5,913,869 A 6/1999 Reil
5,934,526 A 8/1999 Rosenbaum et al.
6,099,545 A 8/2000 Mann et al.
6,138,333 A 10/2000 Hollingworth
7,011,484 B2 * 3/2006 Lee ..... 414/416.03
2002/0041102 A1 * 4/2002 Krauskopf et al. ..... 294/1.1

* cited by examiner

*Primary Examiner*—Jacob K Ackun, Jr.
(74) *Attorney, Agent, or Firm*—Harold L. Novick; Derek Richmond; The Nath Law Group

(57) ABSTRACT

The present invention provides a jewelry holder for a pierced earring. The jewelry holder is generally elongated and is made of a rigid, transparent material. The jewelry holder has a handle portion and a distal tip portion. The distal tip portion has a small hole or bore completely therethrough which a post or hook of a pierced earring may be placed. In use, the post or hook of a pierced earring is inserted in the small hole and the jewelry holder is held by the user (such as a potential purchaser) at the handle portion with one hand. The tip portion with the mounted pierced earring is then held up against the user's earlobe. The user then has a clear, unobscured view of the earring as it will look when actually placed through his or her ear. The invention thus allows the purchaser to "try on" the earrings without the unsanitary side effects of physically placing a new earring in one's ear.

20 Claims, 22 Drawing Sheets

JEWELRY HOLDER

FIELD OF THE INVENTION

The present invention relates to the field of displays for jewelry, and in particular relates to holders for earrings.

BACKGROUND OF THE INVENTION

Pierced earrings usually include a base with a decorative feature and a post or hook on the back of the base or connected to the top of the base which is placed through a pierced hole in the wearer's earlobe. When purchasing pierced earrings, it is desirable to view how the earring will look when worn in one's ear. Therefore, the purchaser must either insert the post or hook into his or her earlobe or hold the earring up to his or her ear and look in a mirror. In addition, after purchase, a similar desire exists to view an earring with clothing the user is wearing without the time and possible discomfort of actually putting on the earring.

The first option of putting the earring in ones earlobe can be unsanitary as it requires contact between a foreign object, i.e. the post of the earring to be purchased, and one's skin. It is likely that other potential purchasers have previously placed that particular earring in their earlobe. Because most stores do not have a policy of cleaning the posts or hooks of earrings after potential purchasers try them on, if a first potential purchaser has an infection in his or her pierced ear, the next potential purchaser to try on a particular earring could possibly contract that infection.

The second option is awkward and not very effective in determining just how the earring will look in one's ear. The view of the earring-in-ear will always be partially or completely obscured by the purchaser's fingers or hand holding the earring next to the earlobe. This is particularly true when purchasing small, stud-type earrings.

Therefore, it is desirable for the earring purchaser to have a device that would allow him or her to be able to view what the earring would truly look like in his or her ear and also do so in a sanitary manner.

SUMMARY OF THE INVENTION

The present invention provides a holder to which a pierced earring can be attached and then held in place by the earlobe of a user to simulate trying on the earring. Thus, the present invention is for the purpose of virtually trying on before purchasing a pierced earring in a sanitary and effective manner without requiring the purchaser to actually place the earring through his or her earlobe.

The present invention is a device to hold a pierced earring for placement proximate to a potential purchaser's ear to simulate an attached earring so that the potential purchaser can see how the earring will look when worn. However, it could similarly be used to position a broach or pin at an appropriate upper torso position, or even position a neckless at the neck area of the user.

In a first specific embodiment, the present invention comprises a holder having an elongate flat body having a first tapered portion at a first end and a bore located near that end and extending completely therethrough. Preferably the bore has a diameter so as to be able to receive a post, hook or other pierced earring attachment means that is inserted through a pierced hole in a wearer's earlobe. The holder body has a second, handle portion integral with said tapered portion.

BRIEF DESCRIPTION OF THE DRAWINGS

FIGS. 18 through 21 are each front elevational views of a group of alternate embodiments of holders according to the present invention that are double ended;

DETAILED DESCRIPTION OF THE INVENTION

Figure 1:
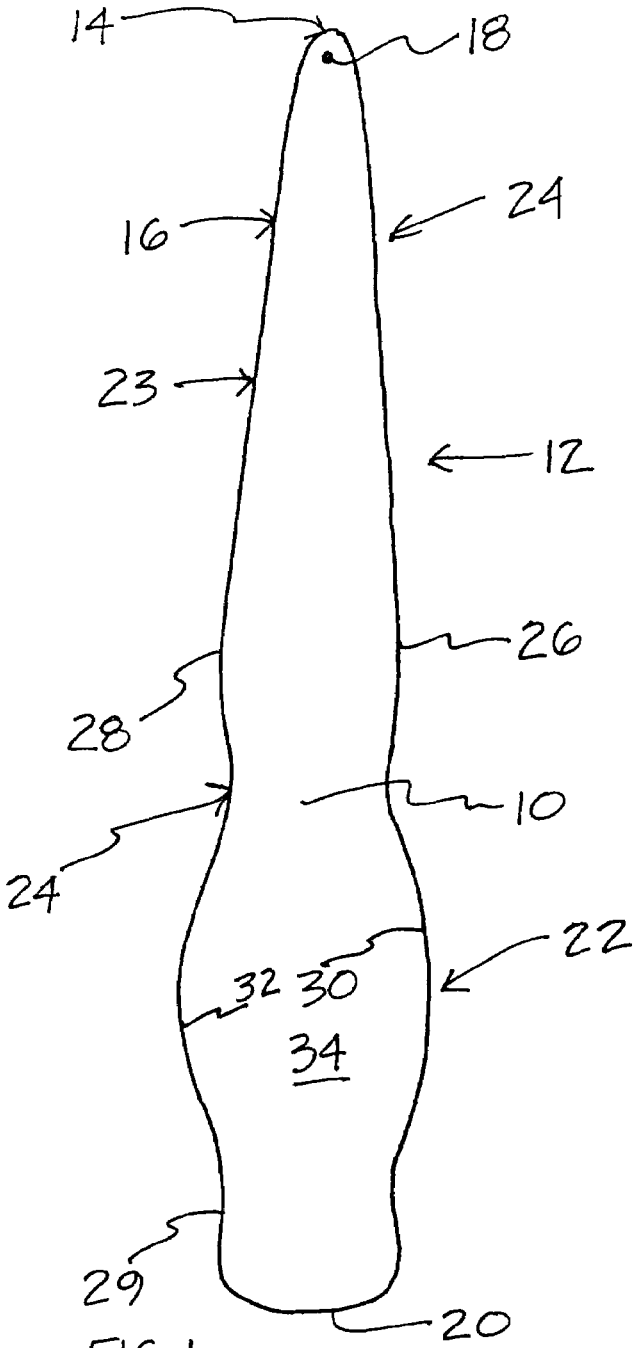
FIG. 1 is a front elevational view in actual size scale of a holder in accordance with the present invention.

With reference now to the drawings wherein like elements throughout the several views have like identification numerals, and in particular with reference to FIG. 1, a generally collinearly shaped earring wand or holder 10 in accordance with the present invention is depicted. Holder 10 is comprised of an elongated, one-piece base or body 12 that is symmetrical about a central longitudinal axis (not shown). Holder 10 has a rounded first end 14 at the terminus of an elongate triangular or pointed portion 16 with a bore or hole 18 spaced from first end 14 and extending completely through body 12. Body 12 has a second end 20 at the terminus of an elongate, bulbous handle portion 22 in elevational view. Intermediate first end 14 and second end 20 is a mid-portion 23. Handle portion 22 is integral and coplanar with mid-portion 23 at a junction 24, and triangular pointed portion 16 is integral and coplanar with mid-portion 23. Second end 20 is wider than first end 14, but is still curvilinear with a much larger curvature of radius than the curvature of radius of first end 14. Holder 10 has a first side edge 26 and an opposite second side edge 28 which extend from ends 14 and 20.

In order to comfortably be held by the user's hand, handle portion 22 is contoured at the bottom. Handle portion 22 has concave first outer edges 30 and 32 beginning from junction 24 with pointed portion 16 which together form a grip region 34. First outer edges 30 and 32 integrally mate with first ends of convex second outer edges 36 and 38 that together form a bulbous section 40 of handle portion 22. Concave third outer edges 42 and 44 which together form a butt section 46 of handle portion 22 integrally mate with second ends of convex second outer edges 36 and 38. In addition in order to increase the comfort of handle portion, the edges of sides 26 and 28 can be rounded.

Figure 2:
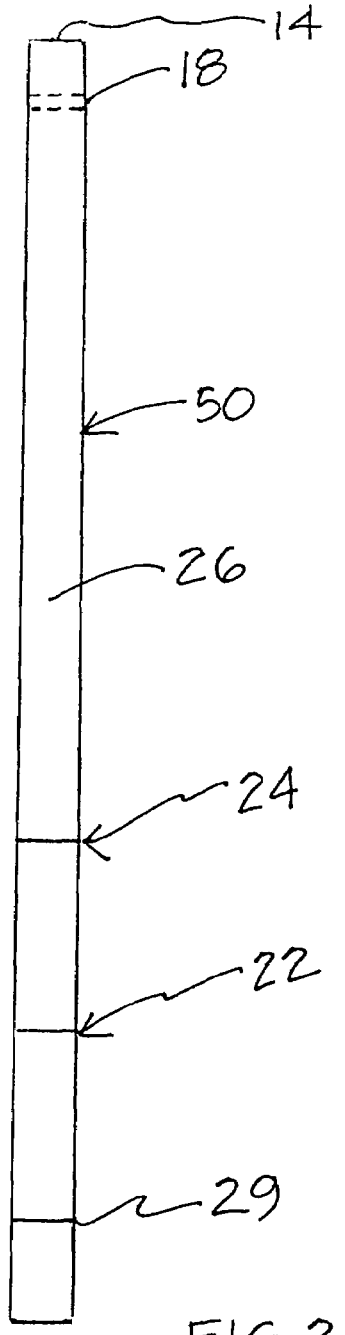
FIG. 2 is a side elevational view of the holder depicted in FIG. 1, but wherein the thickness of the holder body is enlarged so as to be able to show the features thereof.
Figure 3:
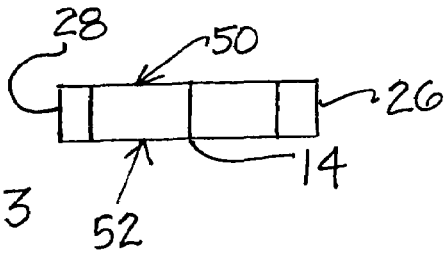
FIG. 3 is an end elevational view of the holder depicted in FIG. 1, but wherein the thickness of the holder body is enlarged so as to be able to show the features thereof.

As seen in FIG. 2, body 12 is relatively thin and flat with co-planar first or front surface 50 and second or back surface 52. The thickness of body 12 is preferable as thin as possible so that parallax and bulkiness are avoided while still permitting body 12 to be rigid and placeable as close to the earlobe as possible. An exemplary thickness is 1/16 inch, but the thickness depends upon the material used so that the resulting holder 10 is rigid, yet thin as possible.

Holder 10 is made from a single piece of a clear non-fogging, non-opaque, lightweight, unbreakable, and rigid material. Holder 10 is made from a durable and lightweight material so it is light enough to be held in one hand, and durable so that it will have a long shelf life, and if dropped will not shatter or otherwise break. In this preferred embodiment, holder 10 is made entirely of a conventional transparent, scratch resistant plastic material such as Lucite®, the trademarked product of Dupont that is a methyl methacrylate polymer. A transparent holder 10 permits the user to see through the holder to determine how an attached earring would look when actually worn by being placed through the earlobe of the user.

In the presently preferred embodiment of the invention, holder 10 is preferable made by stamping it out of a planar sheet of material. The length, or height, of holder 10 is generally elongated and must be long or tall enough to ensure that it can be held in the hand without obscuring the view of the earring held up to the user's ear. In the actual size replication of FIG. 2, the length is 8.5 inches.

Also in the preferred embodiment, handle portion 22 has a flattened shape with a thickness as small as 1/16th of an inch.

Because an important object of the invention is that the user may try on pierced earrings in a sanitary manner, it is necessary that holder 10 be made of a material that is easily cleanable, preferably with a mild soap and water or other cleansers that will not leave a film that may effect the transparency of the material or irritate the skin when holder 10 is held up against a user's earlobe. It is also important that any such cleanser not react with the material of holder 10 and discolor it.

As stated above, holder 10 has hole 18 located near the end thereof Pierced earrings are of generally two types, those with posts that are rigidly attached to decorative bases and meant to be fixed in an earlobe, and much thinner wires, or hoops, which are attached to dangling types of decorative bases and are meant to move about in the earlobe. The post of pierced earrings are of a fairly standardized size and diameter. Hole 18 is relatively small and has a large enough size such that a post of a pierced earring may be easily inserted through it, but still has a small enough size such that an earring post does not have very much play. The back of a post-type earring can then be fitted against the back of holder 10 to hold the earring in place as it would when actually placed through the user's earlobe. A wire connection of a pierced earring is much thinner than the post, allowing the earring to dangle from the earlobe. The wire connection is thin enough, that is it has a high gage, that it can be easily inserted through hole 18.

Front surface 50 can have an indicia 54 imprinted or etched into it. Indicia 54 can be words, such as the exemplary words "The Earringthing by Cidnatopia," an advertising slogan of a sponsor, or an ornamental design. In addition, the transparency of holder 10 can be limited to the pointed portion 18 and a design located on the remaining parts of front surface 50.

Figure 4:
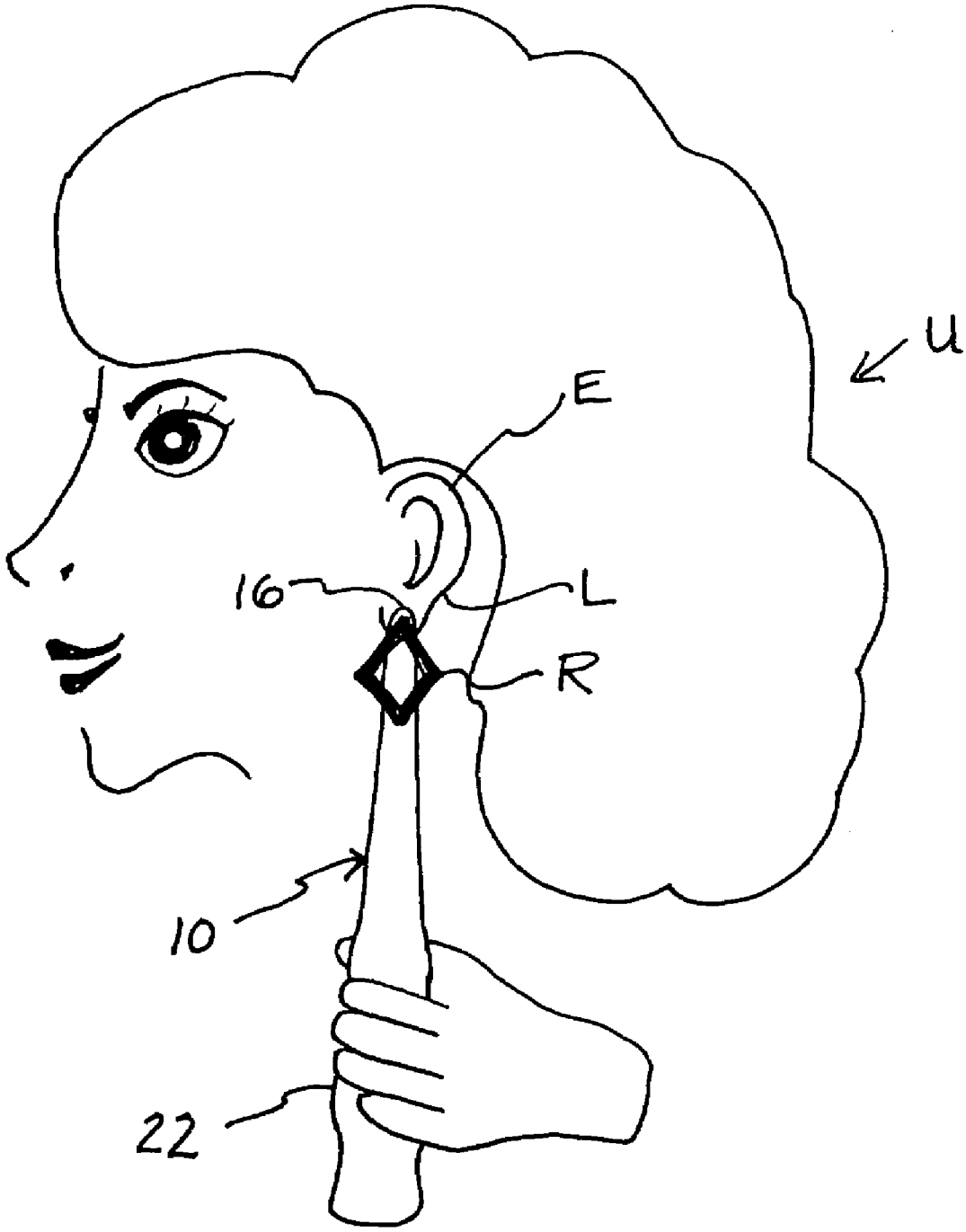
FIGS. 4 and 5 are each a graphical side elevational view of a person shown using a jewelry holder according to a first embodiment of the present invention to display two different types of earrings adjacent to the ear of the user.
Figure 5:
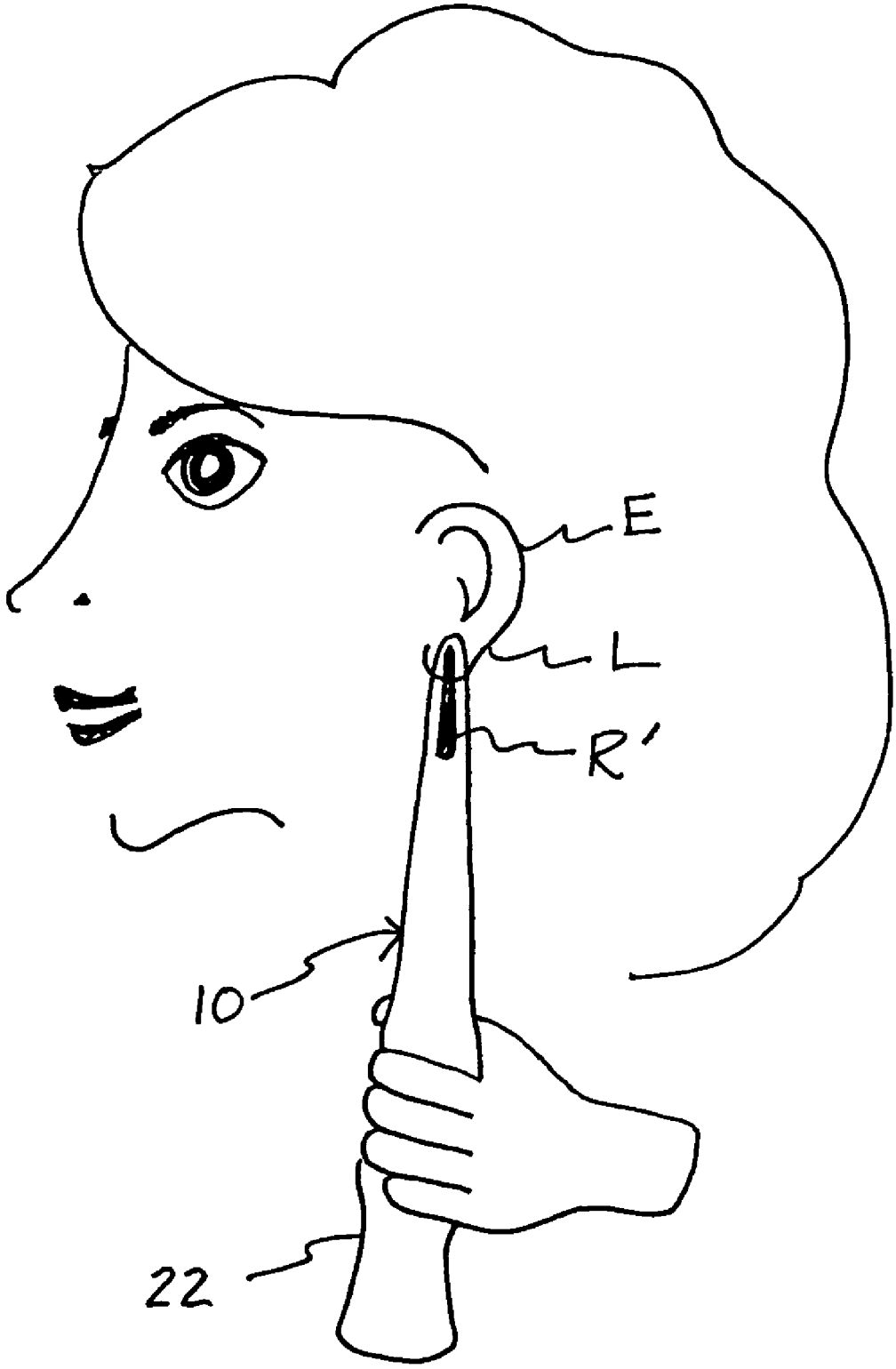

In use, as depicted in FIGS. 4 and 5, a user U of earring wand or holder 10 inserts a post or hook (not shown) of a pierced earring R into hole 18. Holder 10 is then held by handle portion 22 so that pointed portion 16 is located up against an earlobe L of an ear E of a user U, i.e. a potential earring purchaser. In particular, user U places pointed portion 16 of holder 10 in front of user's earlobe L for a pierced earring with a post, and in front or behind earlobe L for a pierced earring with a hook. In FIG. 4, the pierced earring R is larger than the width of pointed portion 16 and in FIG. 5 a pierced earring R' is smaller than the width of pointed portion 16, thereby demonstrating that holder 10 can be used with any size of pierced earring.

When user U placed earring holder 10 to earlobe L, the user U has an unobscured view of what the earring R or the earring R' will look like when actually placed in his or her ear. A potential purchaser can thus "try on" a pierced earring without the unsanitary side effects of physically placing the earring in one's ear before it is cleaned and disinfected.

As mentioned above, in an alternative embodiment, handle portion 22 can be slightly rounded in a third dimension, or even completely rounded, so as to more comfortably fit in the hand. The rounding may be confined to the bottom half, with a tapered, flatter top, or the most of holder 10 can be rounded.

There are many possible alternative embodiments of the present invention. These are depicted in FIGS. 6 through 24.

Figure 6:
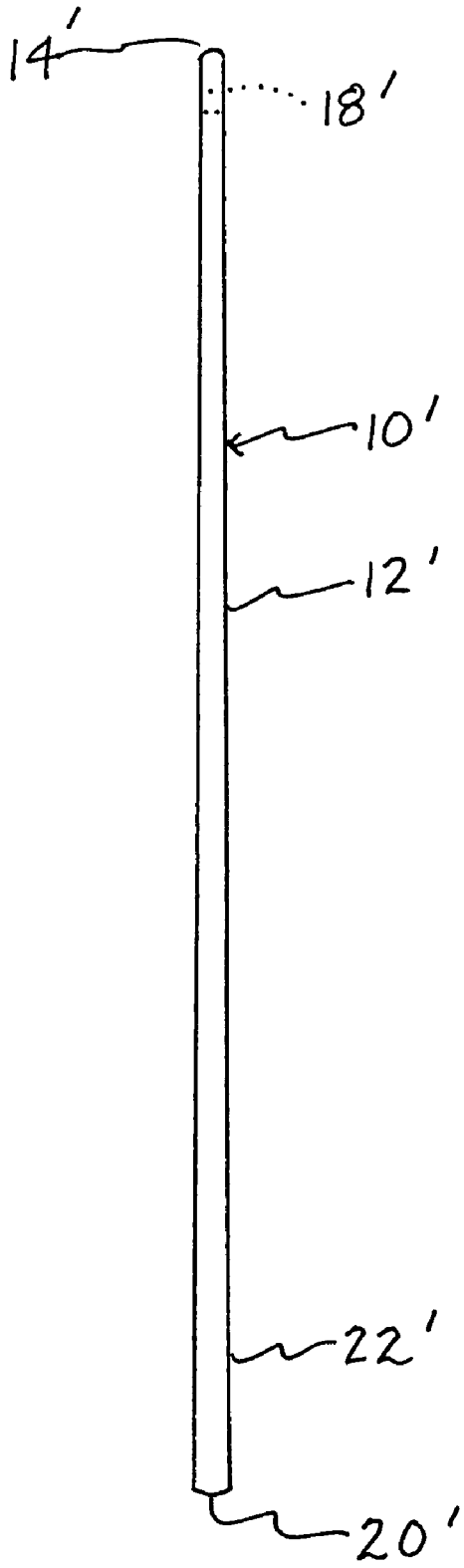
FIG. 6 is a side elevational view of an alternative embodiment of a holder according to the present invention in which the thickness of the holder tapers from a thicker portion at the handle end to a thinner portion at the opposite end in which a hole is located.

In FIG. 6, a second embodiment of a holder 10' in accordance with the present invention is depicted. Holder 10' has a body 12' with a tapered thickness in cross-section such that a tip 14' is thinner than an end 20' of a handle portion 22'. Depending upon the particular material, tapered holder 10' is more flexible than constant thickness holder 10 and presents a smaller, interfering image when a pierced earring is held adjacent an earlobe of a user.

The second embodiment of FIG. 6 depicts a holder 10' that has a constant slope of a taper from first end 14' to second end 20'. However, it would be obvious that handle 10' can have a variable slope taper or a non-linear type slope, just so that first end 14' is thinner than second end 20'.

Holder 10 as depicted in FIGS. 1-5 has a generally elongate, rectilineal shape in a front elevational view. However, in FIGS. 7 through 15, a one-piece earring holder is depicted with a generally elongate, curvilinear shape.

Figure 7:
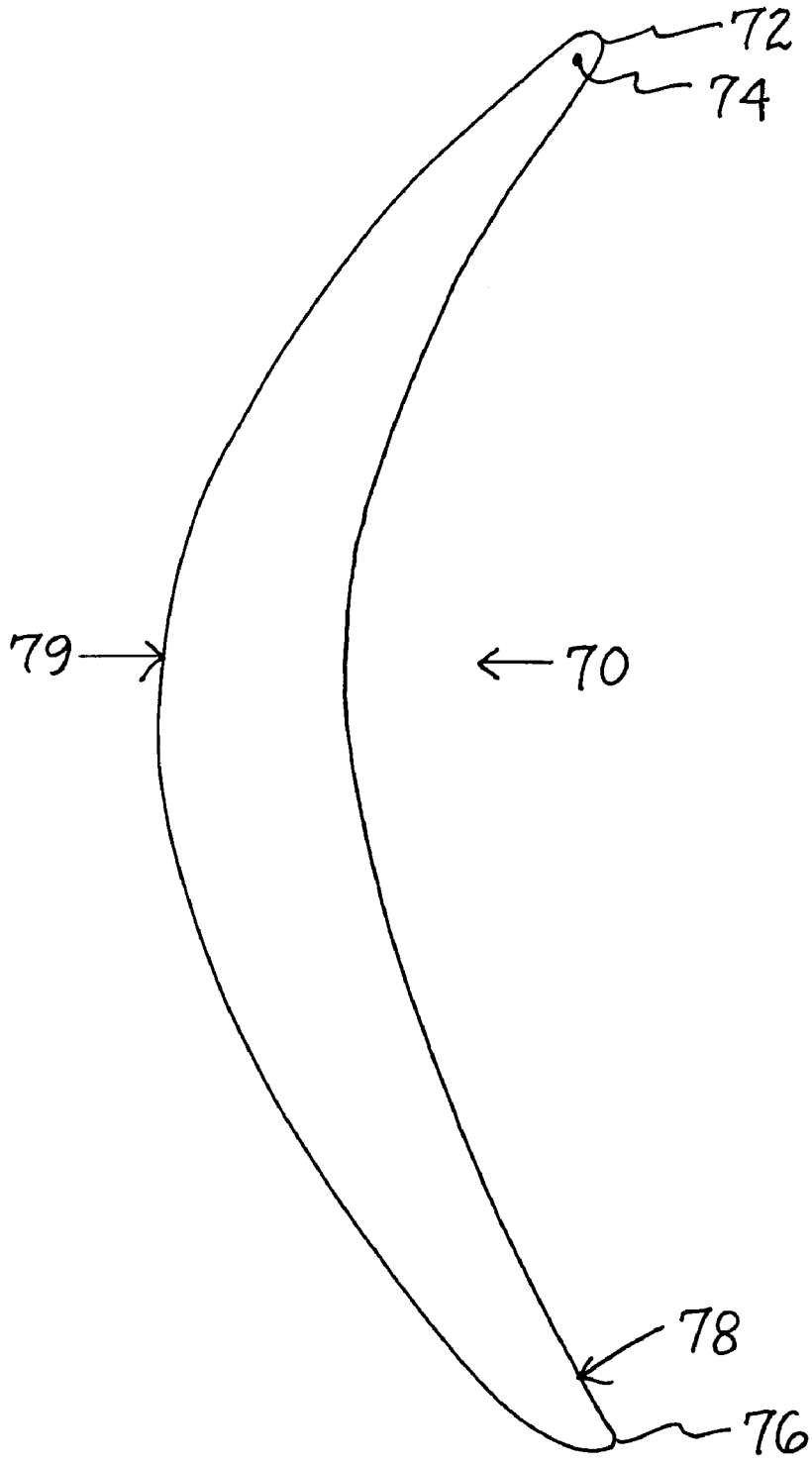
FIGS. 7 through 10 are each front elevational views of a group of alternate embodiments of holders according to the present invention having an overall arcuate shape.

In FIG. 7 an earring holder 70 is depicted with a generally arcuate or crescent shape in front elevational view. Holder 70 has a constant thickness, as does holder 10, and has a first end 72 with a bore 74 and a second end 76 at a handle portion 78. Holder 70 has an enlarged or wider mid-portion 79 than the width of either end 72 or handle portion 78 and second end 76 is pointed as is first end 72.

Figure 8:
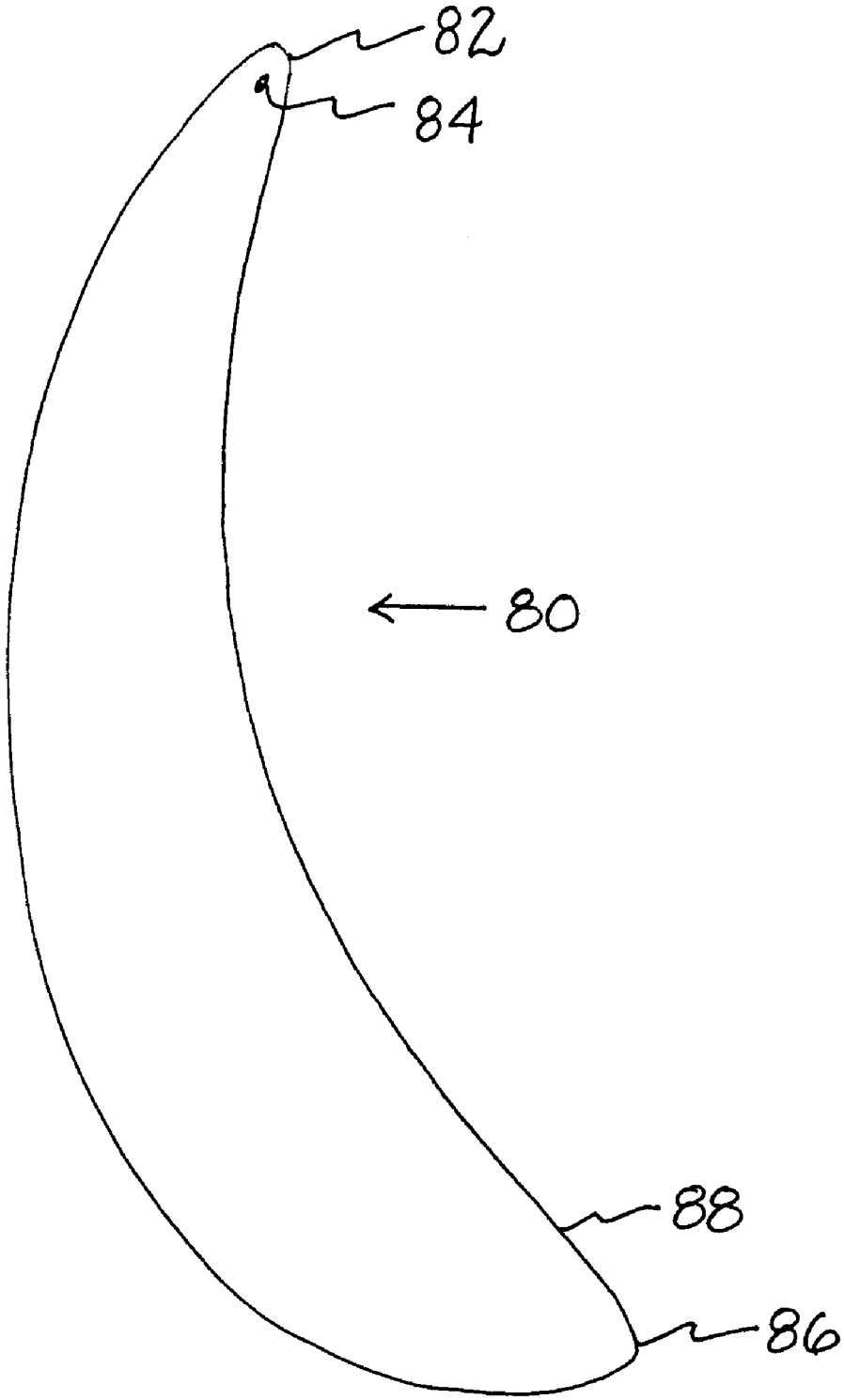

In FIG. 8 an earring holder 80 is depicted with a generally arcuate shape in front elevational view. Holder 80 has a constant thickness, as does holder 10, and has a first end 82 with a bore 84 and a second end 86 at a handle portion 88. In holder 80 there is a tapering in the width from first end 82 to second end 86 such that handle portion 88 is the thickest portion of holder 80. Second end 86 is pointed, as is first end 82, albeit second end 86 is much wider.

Figure 9:
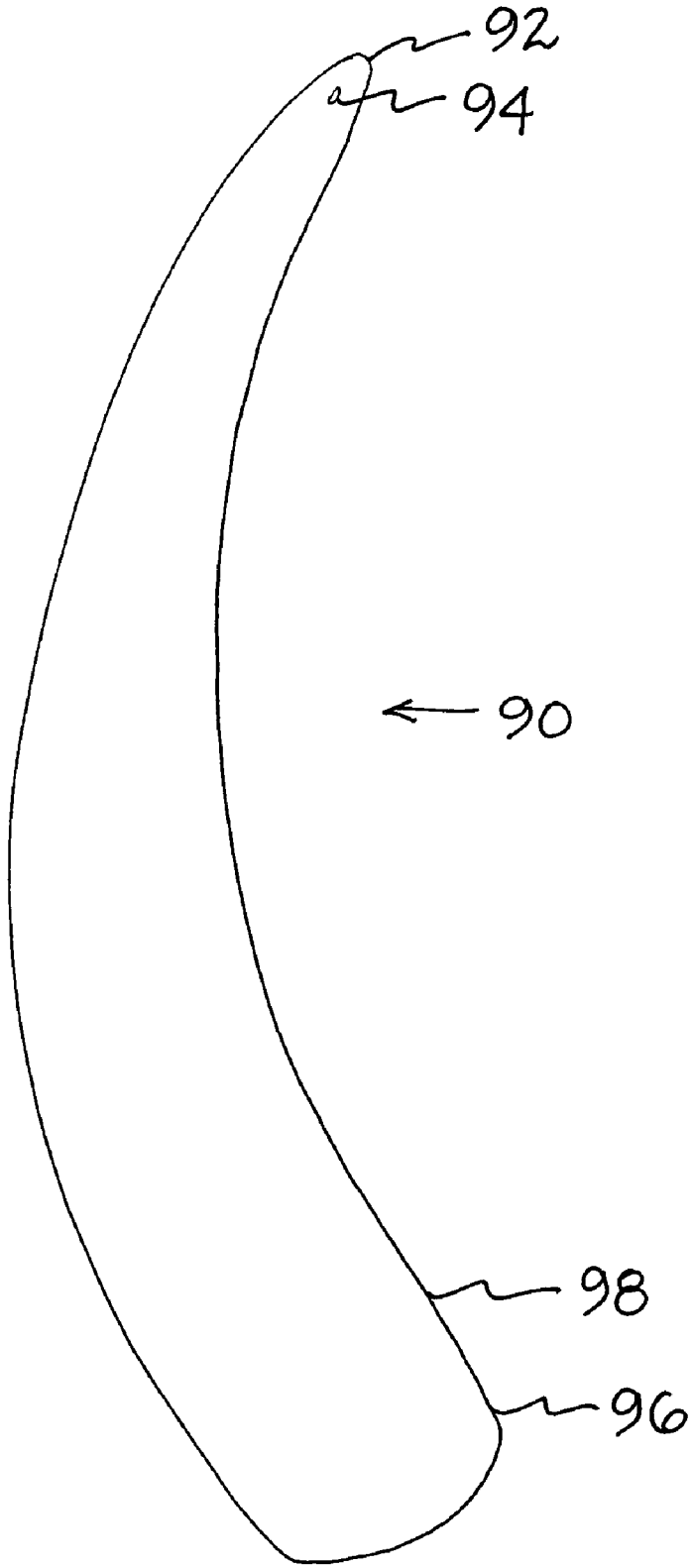

In FIG. 9 an earring holder 90 is depicted with a generally arcuate shape in front elevational view. Holder 90 has a constant thickness, as does holder 10, and has a first end 92 with a bore 94 and a second end 96 at a handle portion 98. Holder 90 is very similar to holder 80 in FIG. 8, except that second end 96 has a generally flat curve instead of being pointed.

Figure 10:
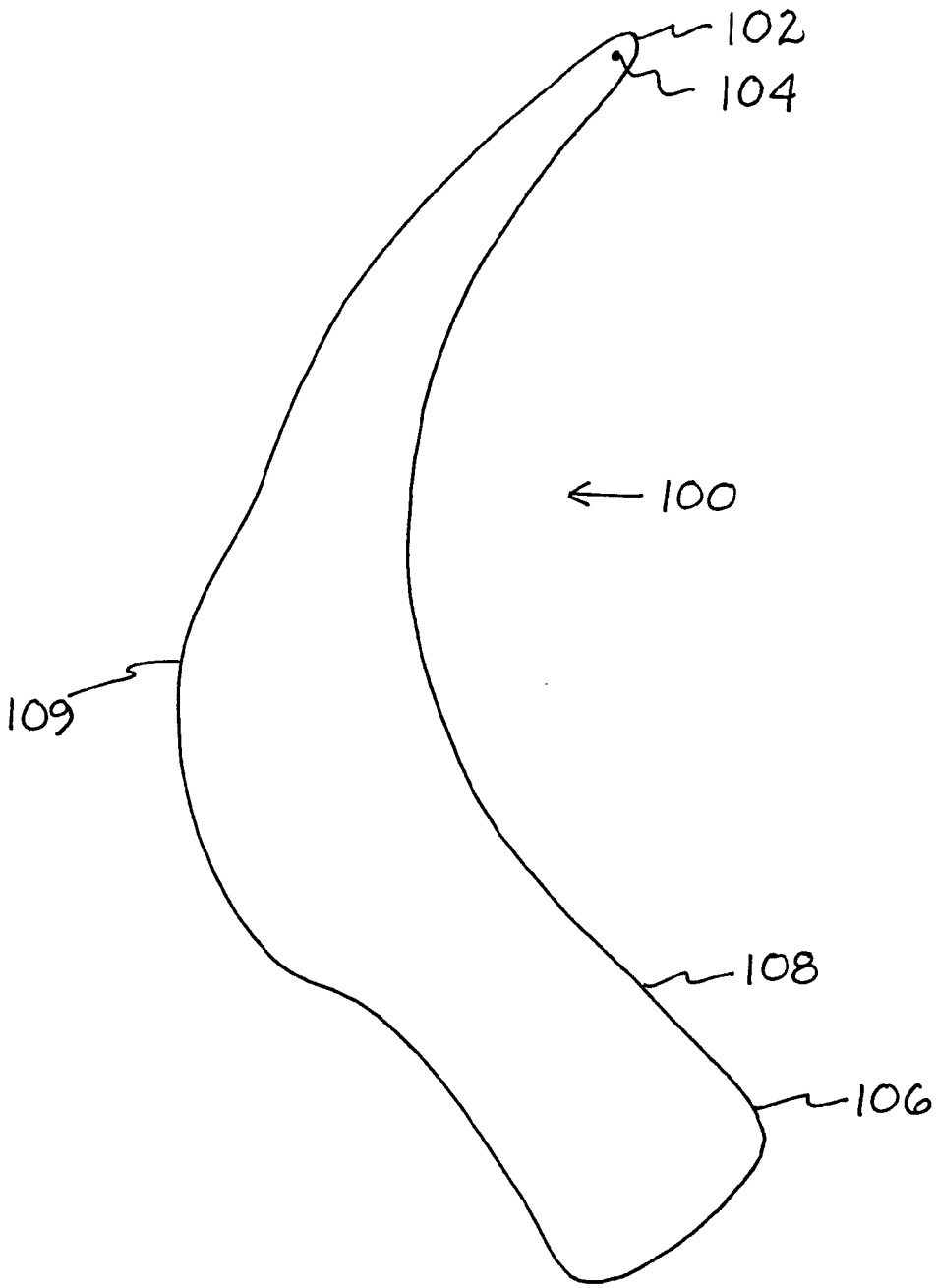

In FIG. 10, an earring holder 100 is depicted with a generally arcuate shape in front elevational view. Holder 100 has a constant thickness, as does holder 10, and has a first end 102 with a bore 104 and a second end 106 at a handle portion 108. Second end 106 of holder 100 is similar in shape to second end 96 of holder 90 in FIG. 9. However, holder 100 has a greatly enlarged mid-portion 109.

Figure 11:
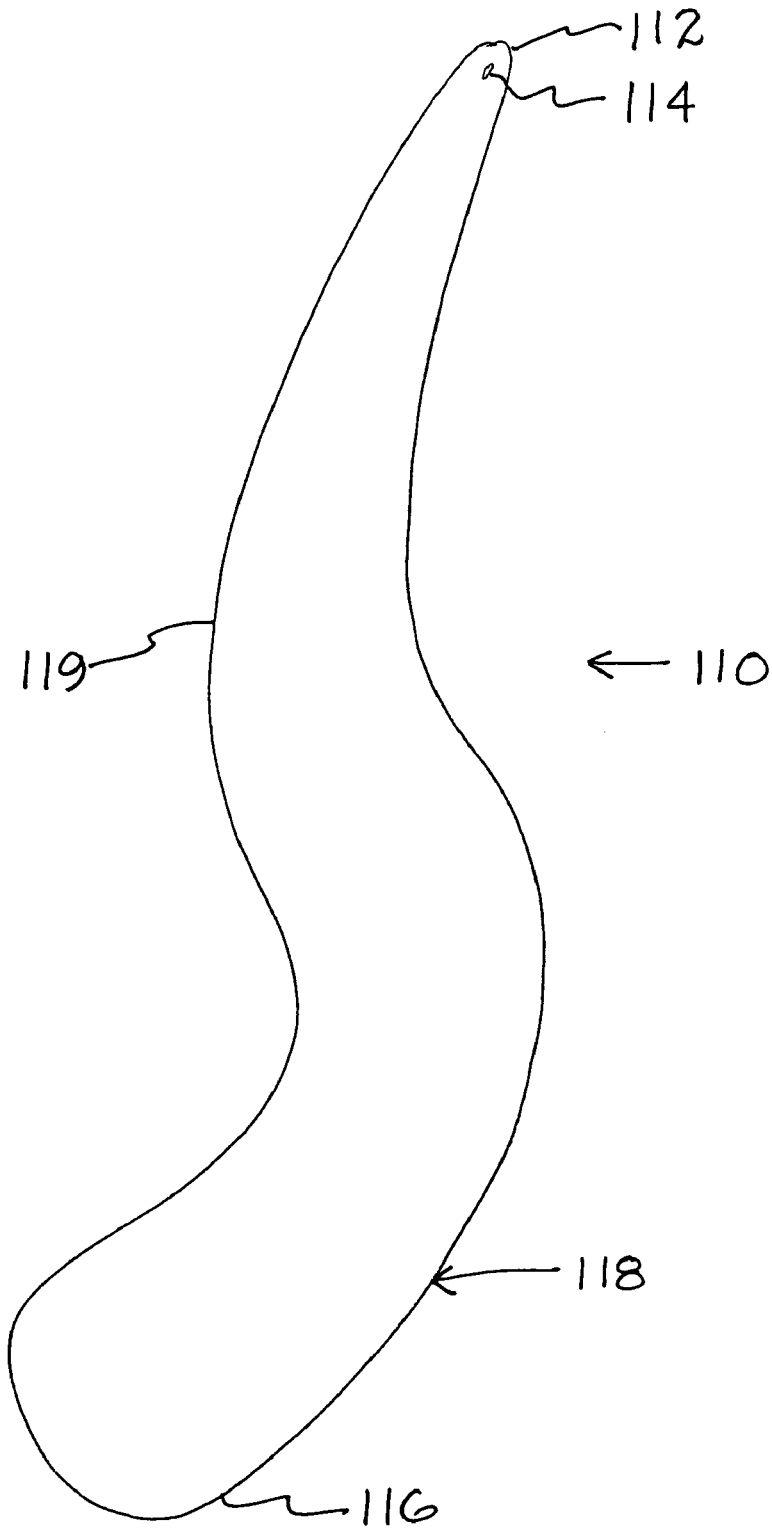
FIGS. 11 through 13 are each front elevational views of a group of alternate embodiments of holders according to the present invention having an overall "S" or double bend shape.

In FIG. 11, an earring holder 110 is depicted with a generally arcuate shape that has two bends so as to form an "S" shape in front elevational view. Holder 110 has a constant thickness, as does holder 10, and has a pointed, first end 112 with a bore 114 and a rounded, second end 116 at a handle portion 118. A mid-section 119 is between first end 112 and second end 116. First end 112 extends to one side of holder 110 and second end 116 of holder 110 extends to the other side, as opposed to being collinear with a central axis as is second end 96 of holder 90 in FIG. 9.

Figure 12:
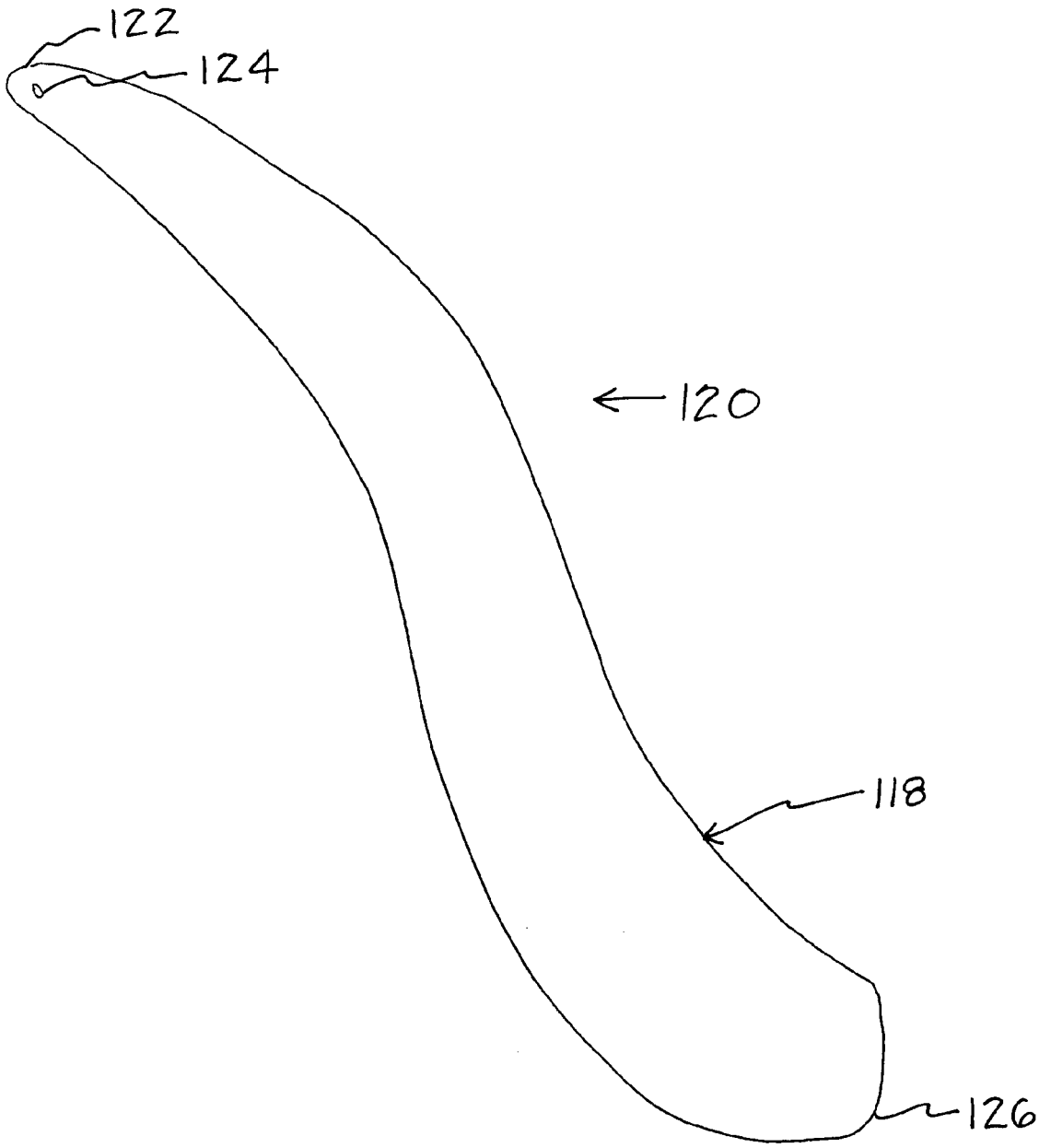

In FIG. 12, an earring holder 120 is depicted with a generally arcuate shape that has two bends so as to form an inverted "S" shape in front elevational view. Holder 120 has a constant thickness, as does holder 10, and has a pointed, first end 122 with a bore 124 and a rounded, second end 126 at a handle portion 128. First end 122 extends to one side of holder 120 and second end 126 of holder 120 extends to the other side, as opposed to being collinear with a central axis as is second end 96 of holder 90 in FIG. 9.

Figure 13:
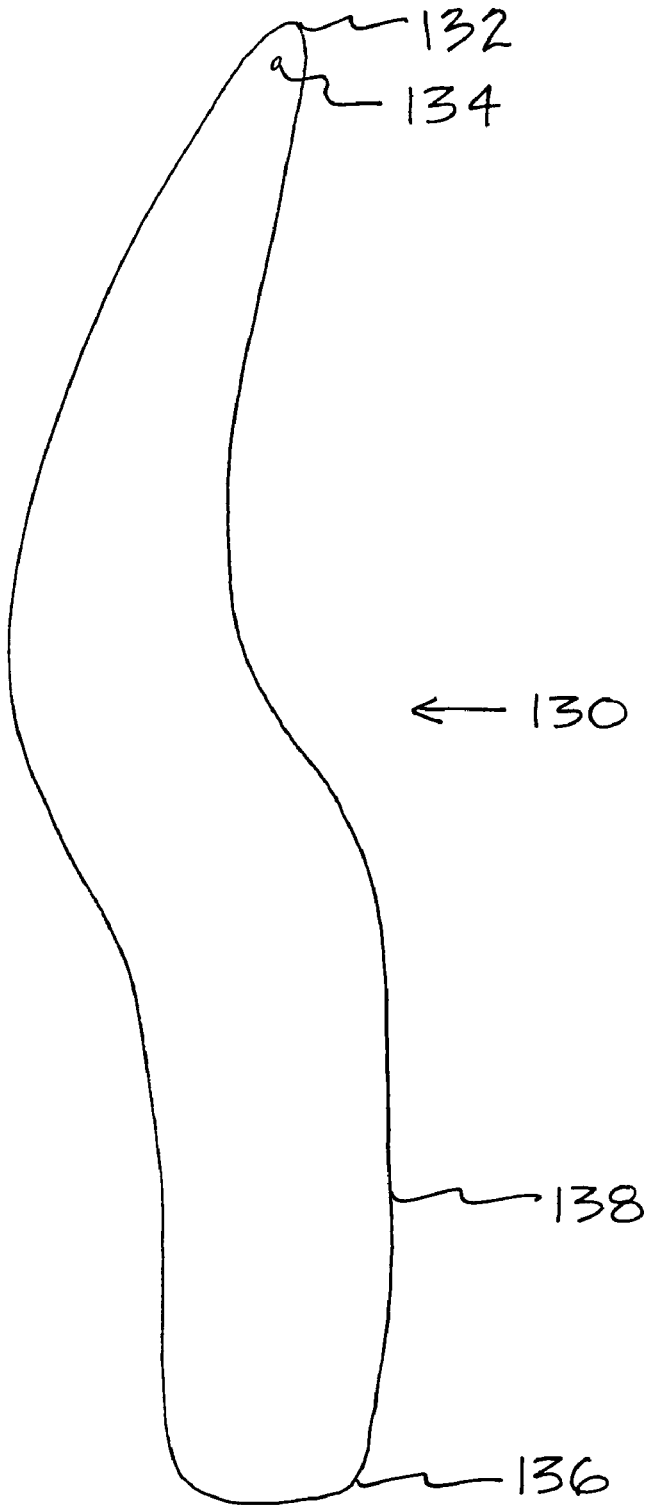

In FIG. 13, an earring holder 130 is depicted with a generally arcuate shape in front elevational view. Holder 130 has a constant thickness, as does holder 10, and has a pointed, first end 132 with a bore 134 and a generally straight or flat, second end 136 at a handle portion 138. First end 132 of holder 130 extends to one side of holder 130 whereas second end 136 of holder 130 is generally collinear with a cental axis of holder 130.

Figure 14:
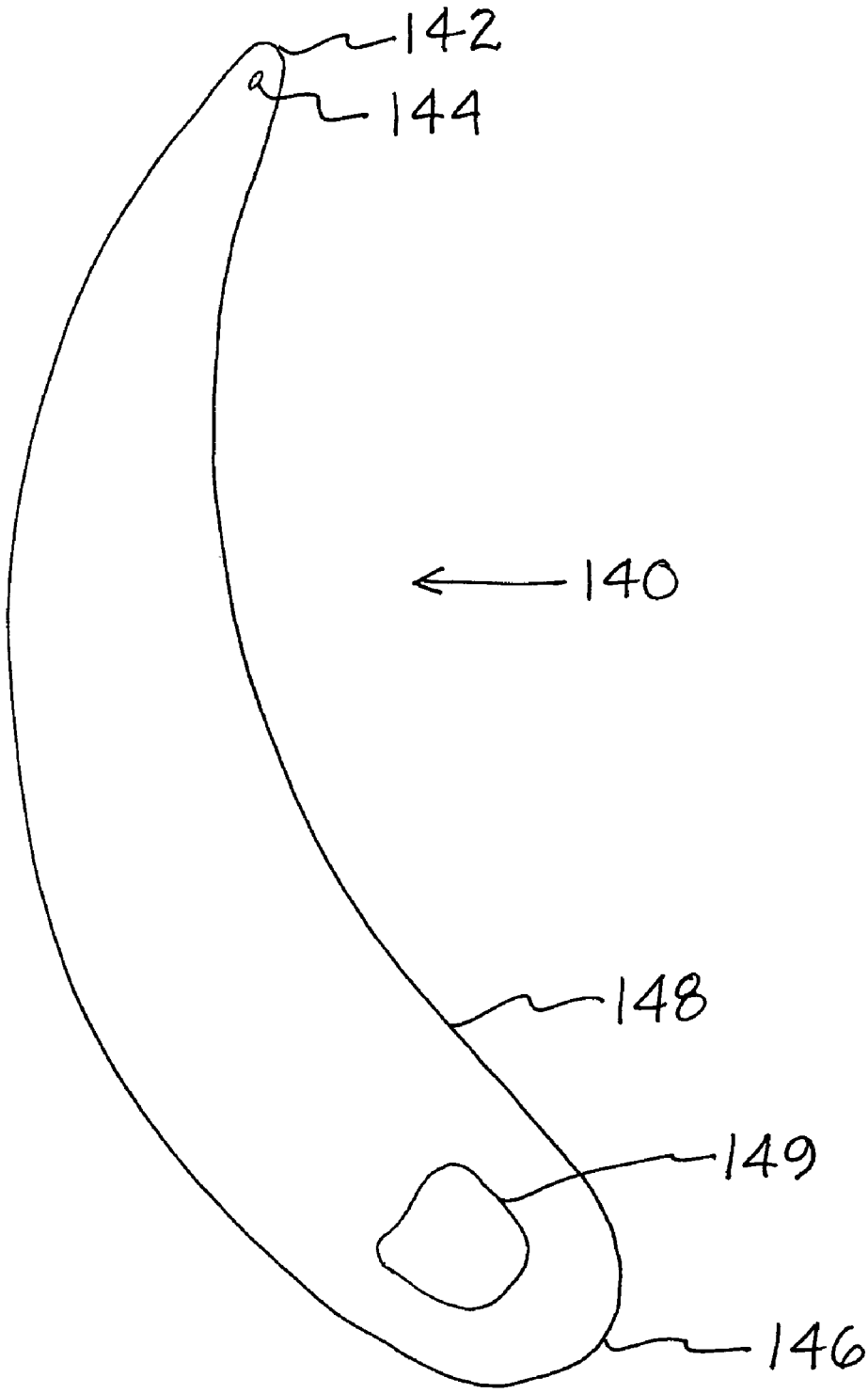
FIGS. 14 through 20 are each front elevational views of a group of alternate embodiments of holders according to the present invention which include a relatively large opening in a central or end portion of the holder.

In FIG. 14, an earring holder 140 is depicted with a generally arcuate, crescent shape in front elevational view. Holder 140 has a constant thickness, as does holder 10, and has a pointed, first end 142 with a bore 144 and a rounded, second end 146 at a handle portion 148. Handle portion 148 has a generally square cutout 149 with rounded corners in it. Cutout 149 not only adds a decorative feature to holder 140, but it also provides it with a hang hole. Second end 146 of holder 140 is similar in shape to second end 96 of holder 90 in FIG. 9.

Figure 15:
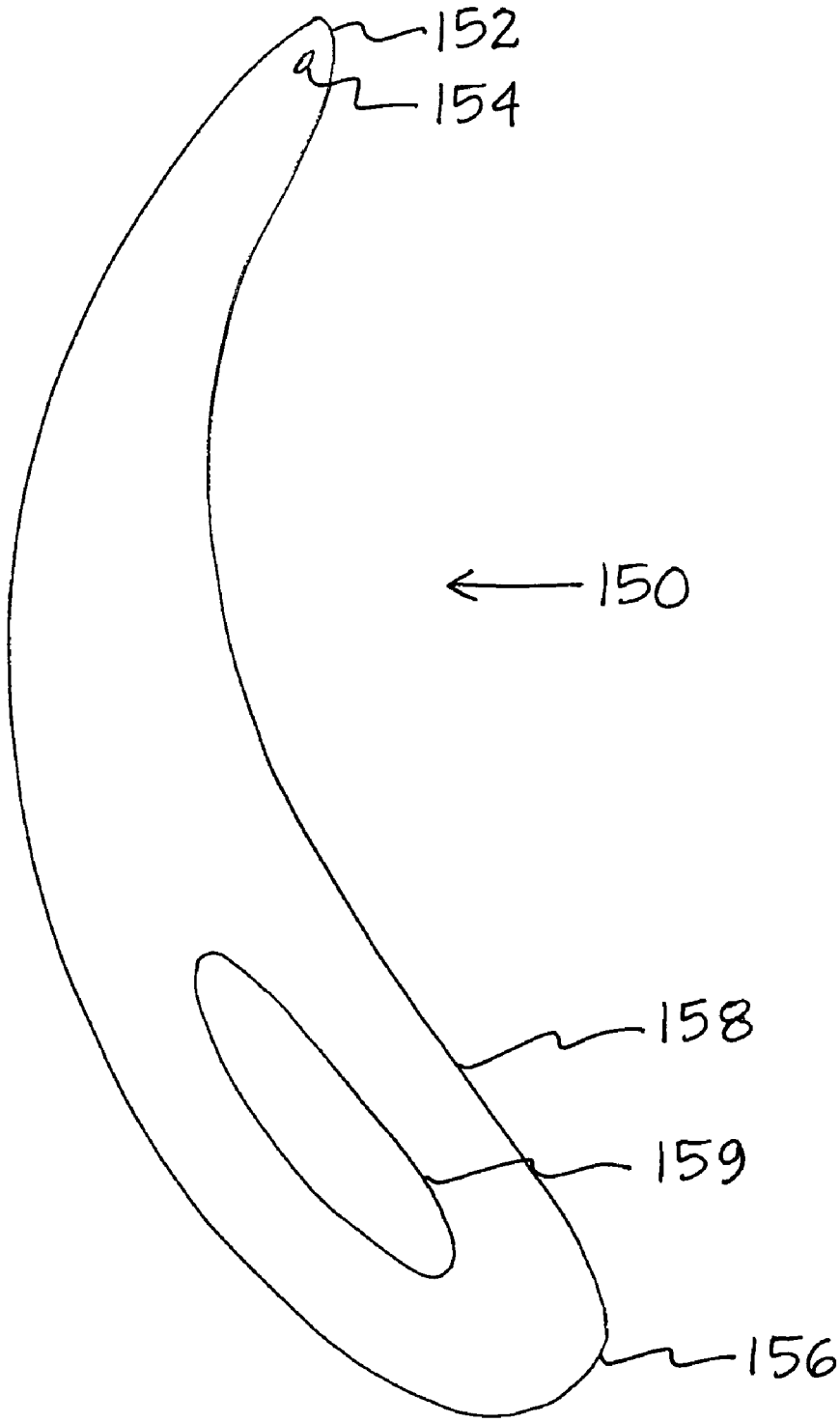

In FIG. 15, an earring holder 150 is depicted with a generally arcuate, crescent shape in front elevational view, which is somewhat similar to the overall shape of earring holder 140 in FIG. 14. Holder 150 has a constant thickness, as does holder 10, and has a pointed, first end 152 with a bore 154 and a rounded, second end 156 at a handle portion 158. Handle portion 158 has a generally elongated ovular cutout 159 with somewhat pointed ends. Cutout 159 not only adds a decorative feature to holder 150, but it also provides it with a hang hole. Second end 156 of holder 150 is similar in shape to second end 96 of holder 90 in FIG. 9.

In FIGS. 14 and 15 described hereinabove, and in FIGS. 18 through 20, a one-piece earring holder is depicted with a cutout in the body thereof.

Figure 16:
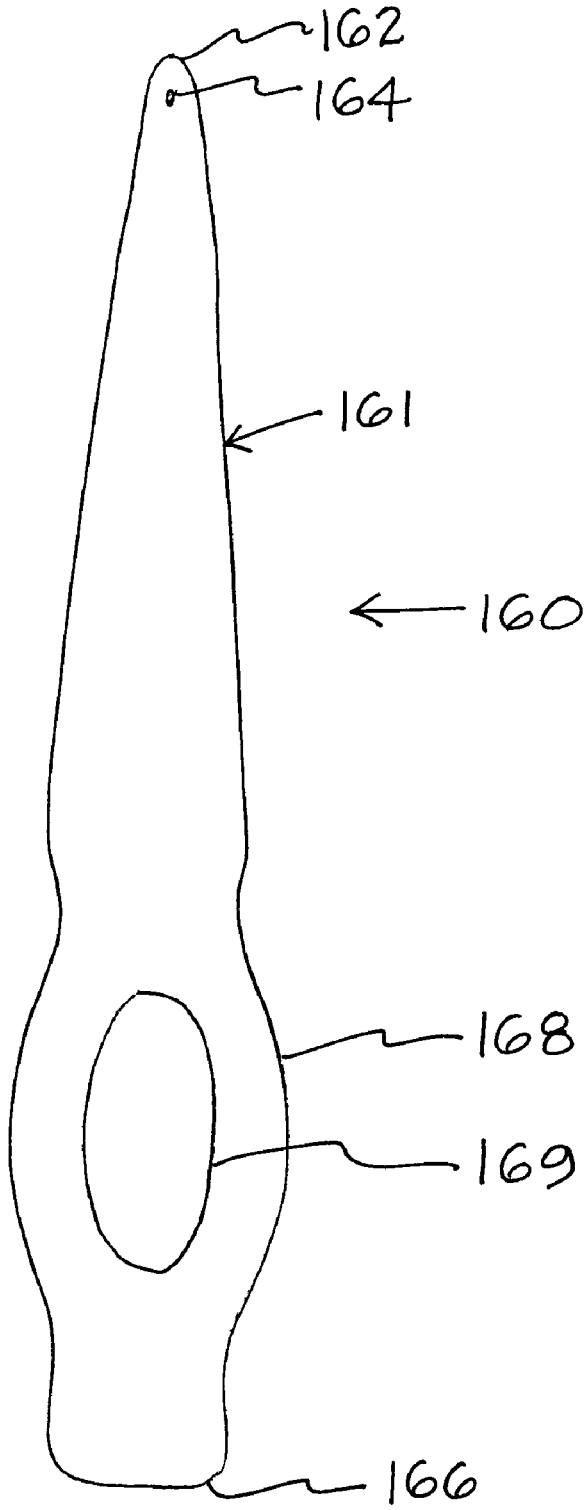

In FIG. 16, an earring holder 160 is depicted with an elongate, collinear body 161 that is generally symmetrical about a central axis (not shown) in front elevational view, which is substantially the same as the overall shape of earring holder 10 in FIG. 1. Holder 160 has a constant thickness, as does holder 10, and has a pointed, first end 162 with a bore 164 and a substantially flat, second end 166 with rounded corners at a handle portion 168. Handle portion 168 has a generally ovular cutout 169 with somewhat rounded ends. Cutout 169 not only adds a decorative feature to holder 160, but it also provides it with a hang hole.

Figure 17:
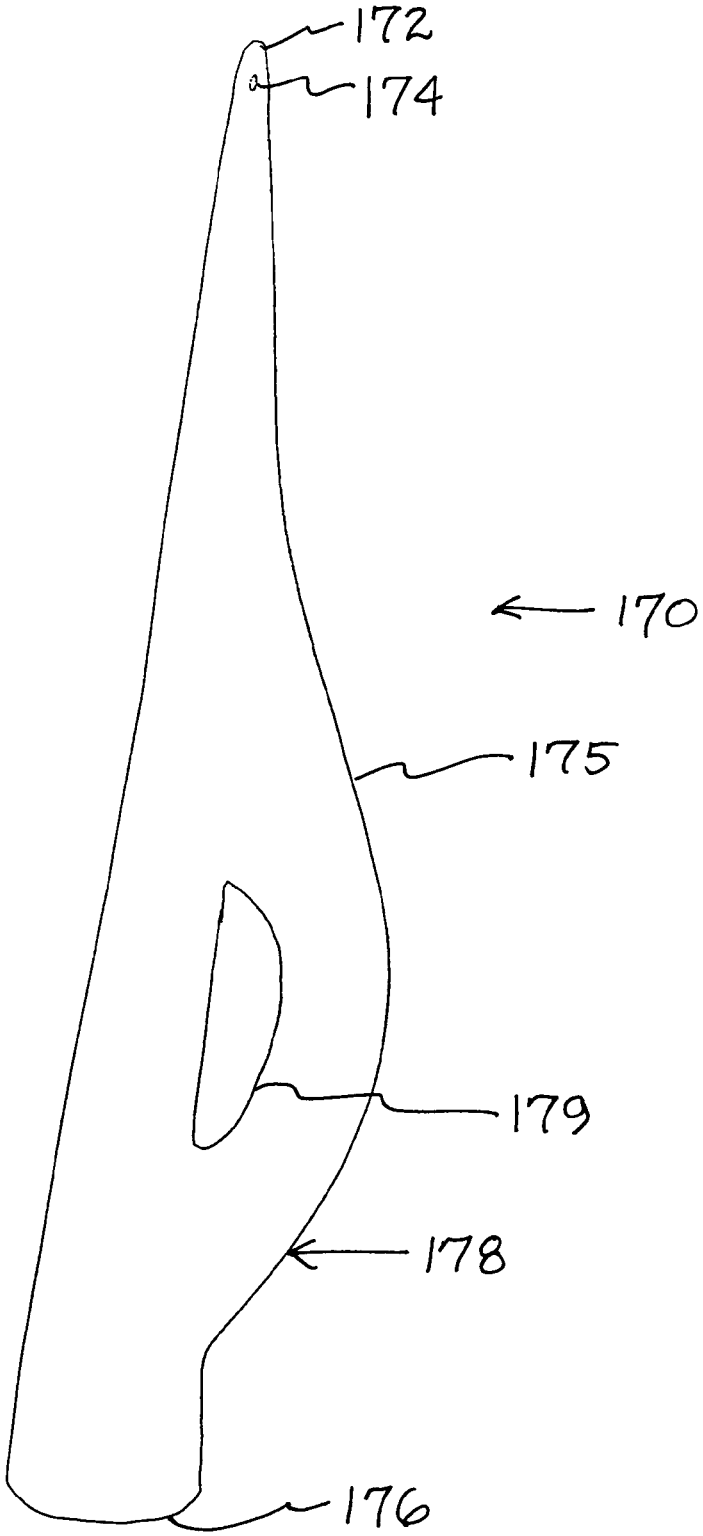

In FIG. 17, an earring holder 170 is depicted with an elongate, collinear body 171 in front elevational view. Holder 170 has a constant thickness, as does holder 10, and has a pointed, first end 172 with a bore 174. However, holder 170 has a greatly enlarged mid-portion 175, and has a substantially flat, second end 176 with rounded corners at a handle portion 178. Mid-portion 175 has a generally D-shaped cutout 179 that is somewhat similar in shape with a outer rounded edge of mid-portion 175. Cutout 179 also has somewhat rounded ends. Cutout 179 not only adds a decorative feature to holder 170, but it also provides it with a hang hole.

Figure 18:
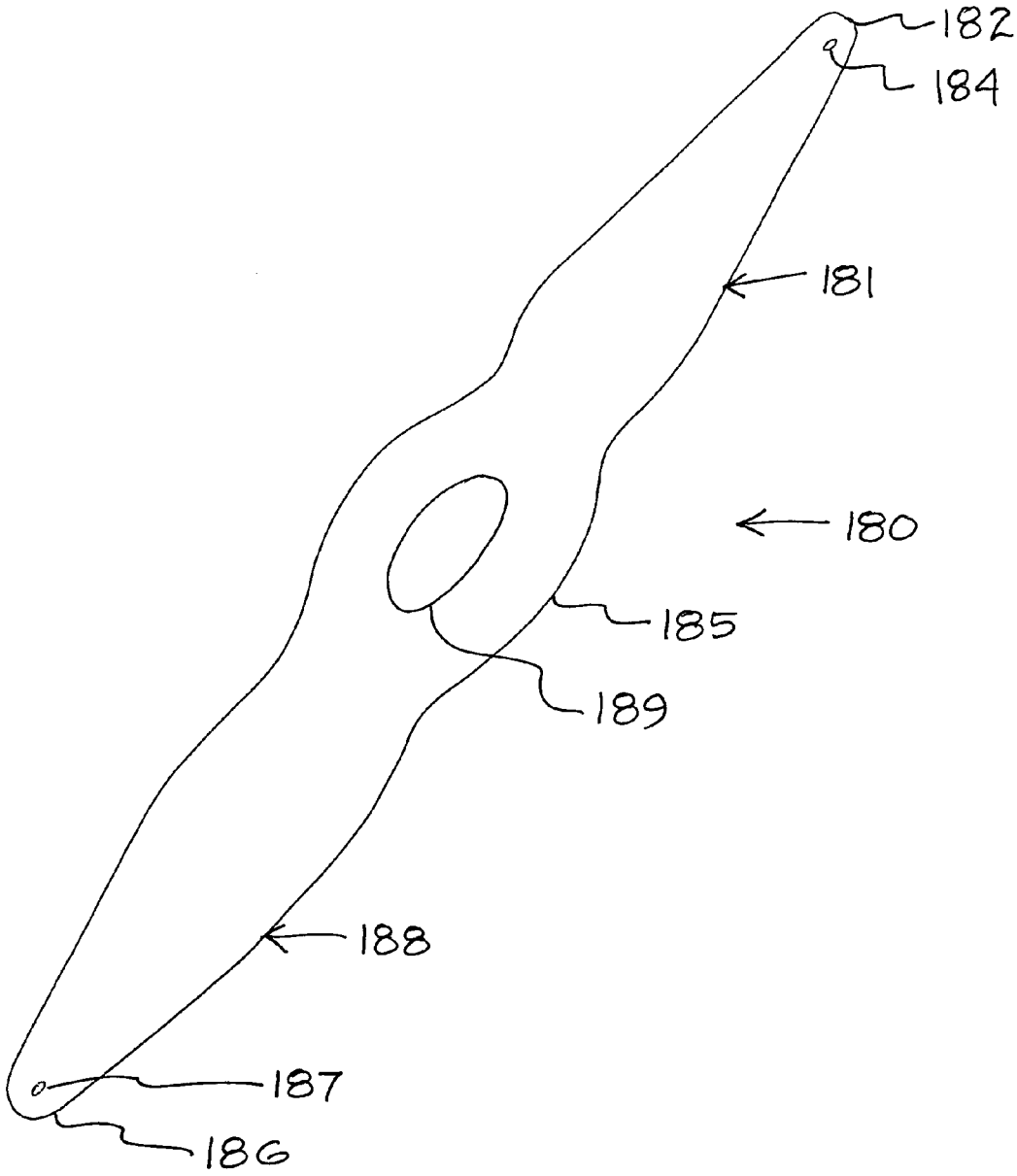

In FIG. 18, an earring holder 180 is depicted with an elongate, collinear body 181 that is generally symmetrical about a central axis (not shown) in front elevational view. Holder 180 has a constant thickness, as does holder 10, and has a pointed, first end 182 with a bore 184, an enlarged mid-potion 185, and a pointed, second end 186 with a bore 187 that has the same size and features as hole 18 in FIG. 1. Either first end 182 or second end 186 can be a handle portion 188 if the other end is used to mount a pierced earring. Mid-portion 185 has a generally ovular cutout 189 with somewhat rounded ends. Cutout 189 not only adds a decorative feature to holder 180, but it also provides it with a hang hole.

Figure 19:
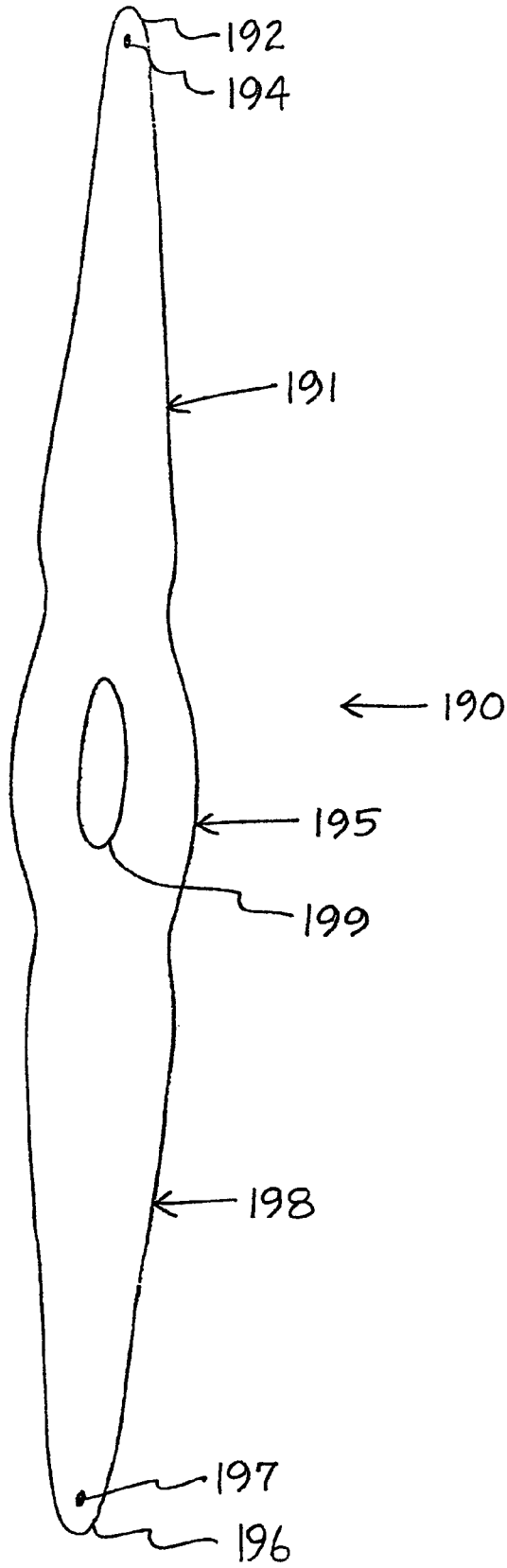

In FIG. 19, an earring holder 190 is depicted with an elongate, collinear body 191 that is generally symmetrical about a central axis (not shown) in front elevational view. Holder 190 has a constant thickness, as does holder 19, and has a pointed, first end 192 with a bore 194, an enlarged mid-potion 195, and a pointed, second end 196 with a bore 197 that has the same size and features as hole 18 in FIG. 1. Holder 190 is very similar to holder 180, except that holder 190 is slimmer or thinner than holder 180. Either first end 192 or second end 196 can be a handle portion 198 if the other end is used to mount a pierced earring. Mid-portion 195 has a generally ovular cutout 199 with somewhat rounded ends. Cutout 199 not only adds a decorative feature to holder 190, but it also provides it with a hang hole.

Figure 20:
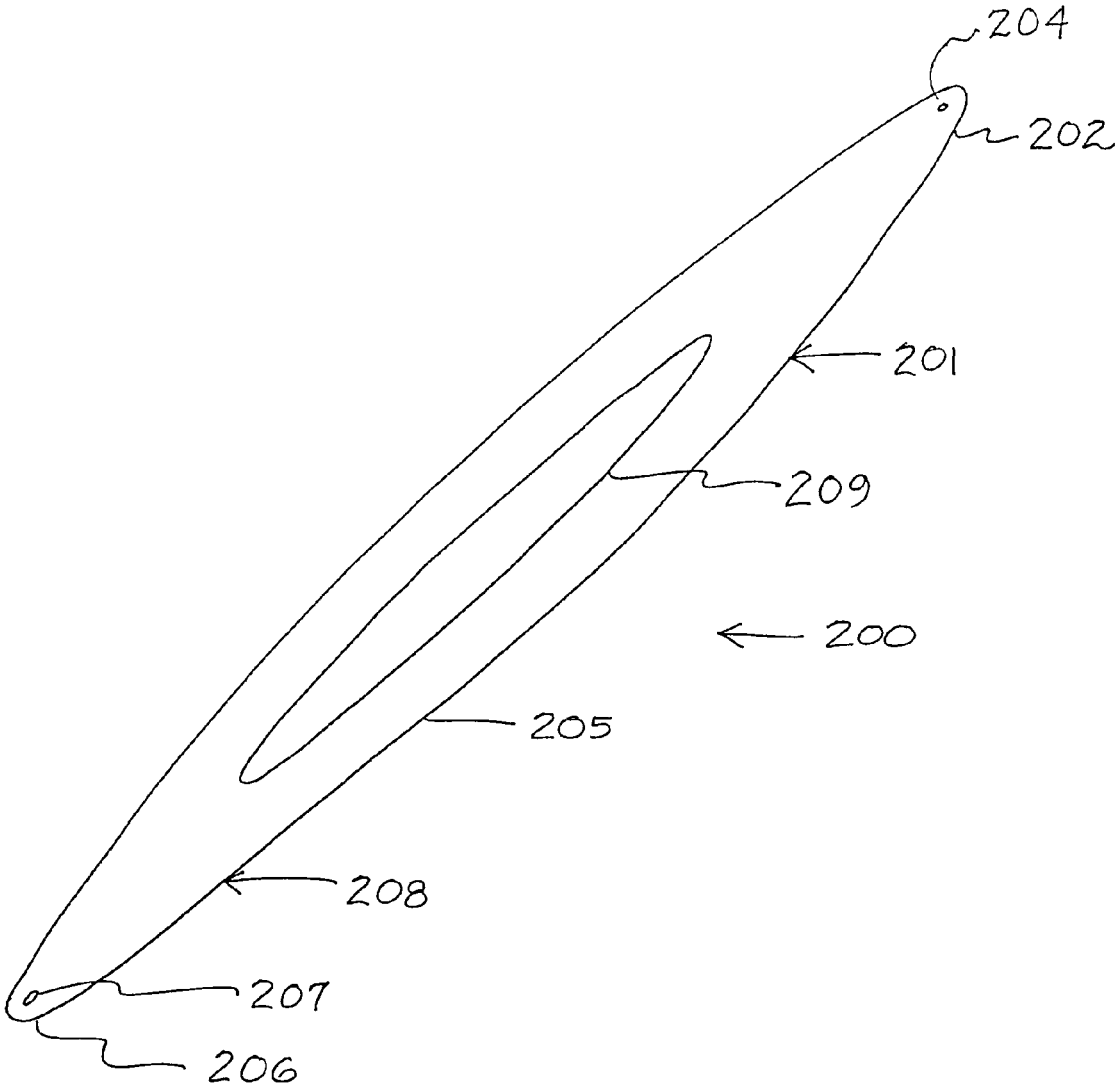

In FIG. 20, an earring holder 200 is depicted with an elongate, collinear body 201 that is generally symmetrical about a central axis (not shown) in front elevational view. Holder 200 has a constant thickness, as does holder 19, and has a pointed, first end 202 with a bore 204, a mid-potion 205, and a pointed, second end 206 with a bore 207 that has the same size and features as hole 18 in FIG. 1. Holder 200 is somewhat similar to holder 190, except that holder 200 is slimmer or thinner than holder 180, and does not have a bulbous or enlarged mid-portion. Either first end 202 or second end 206 can be a handle portion 208 if the other end is used to mount a pierced earring. Mid-portion 205 has an elongated, generally ovular cutout 209 with somewhat rounded ends. Cutout 209 not only adds a decorative feature to holder 200, but it also provides it with a hang hole.

In FIGS. 18 and 20 described hereinabove, and in FIG. 21, a one-piece earring holder is depicted with two pointed ends each with a bore or hole therethrough and which are interchangeable, in that one end can be a handle and the other end can mount the pierced earring.

Figure 21:
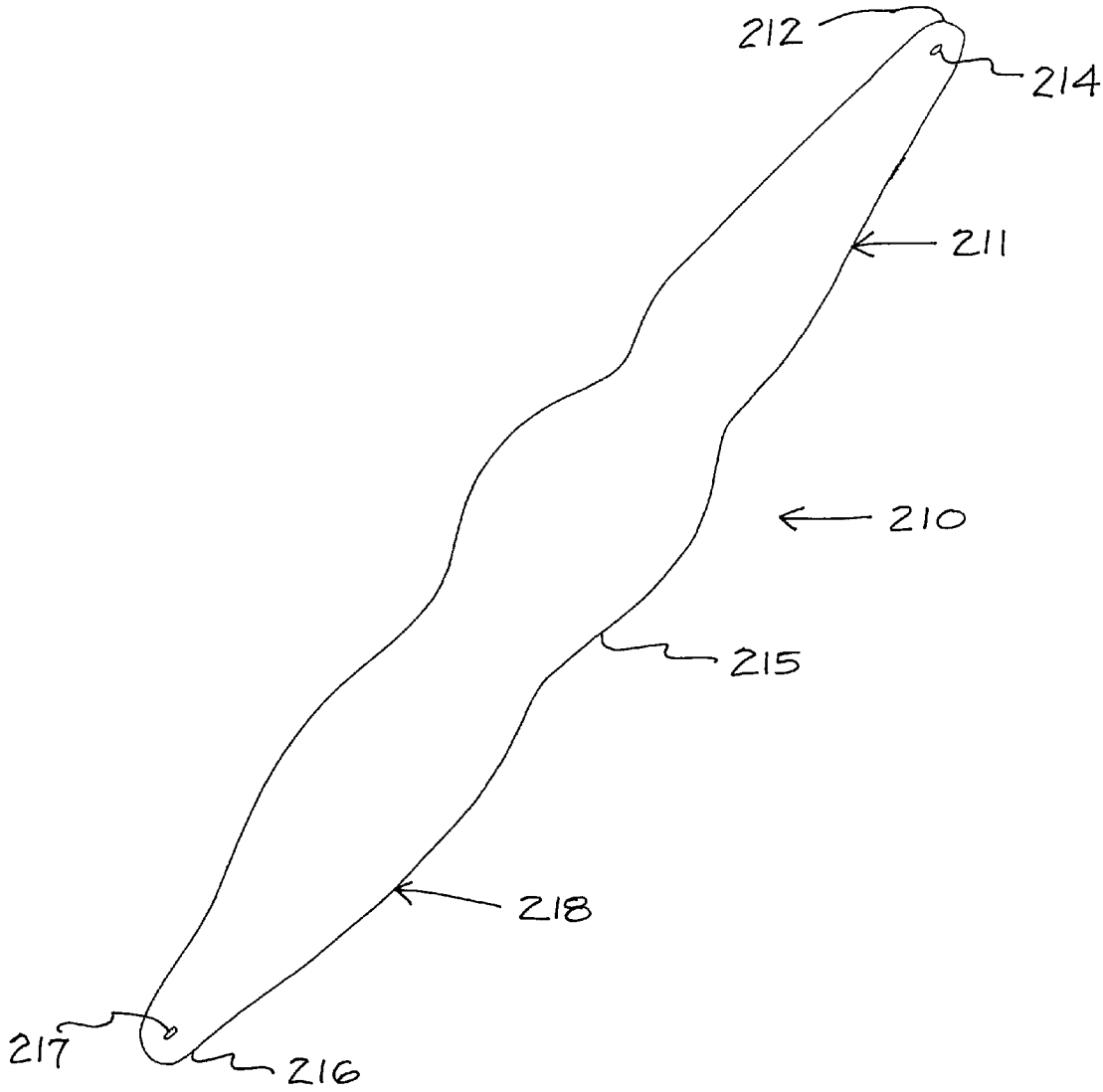

In FIG. 21, an earring holder 210 is depicted with an elongate, collinear body 211 that is generally symmetrical about a central axis (not shown) in front elevational view. Holder 210 has a constant thickness, as does holder 19, and has a pointed, first end 212 with a bore 214, a bulbous mid-portion 215, and a pointed, second end 216 with a bore 217 that has the same size and features as hole 18 in FIG. 1. Holder 210 is very similar to holder 190, except that holder 210 does not have a cutout in a mid-portion. Either first end 212 or second end 216 can be a handle portion 218 if the other end is used to mount a pierced earring.

Figure 22:
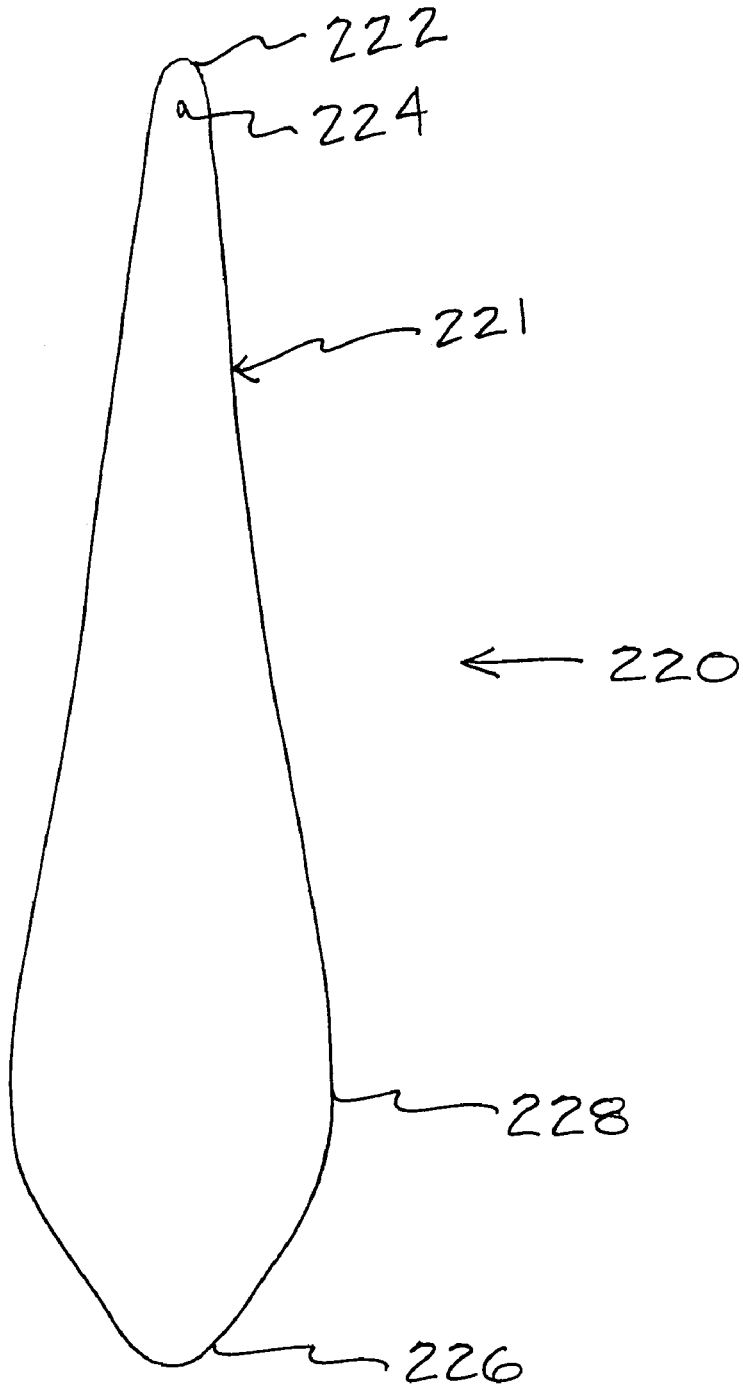
FIGS. 22 through 23 are each front elevational views of a group of alternate embodiments of holders according to the present invention that overall are elongate, dagger-shaped.

In FIG. 22, an earring holder 220 is depicted with an elongate, collinear body 221 that is generally symmetrical about a central axis (not shown) in front elevational view. Holder 220 has a constant thickness, as does holder 10, and has a pointed, first end 222 with a bore 224 and a pointed, rounded second end 226 with a bulbous handle portion 228.

Figure 23:
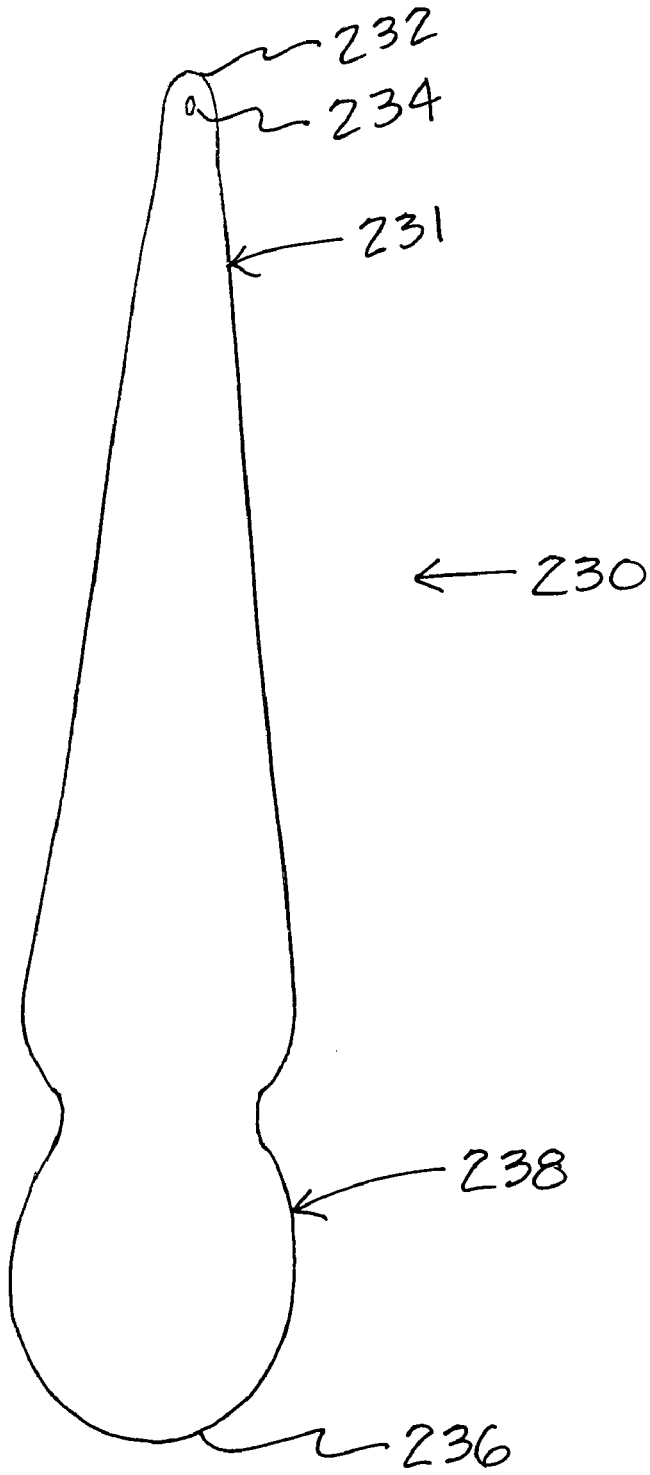

In FIG. 23, an earring holder 230 is depicted with an elongate, collinear body 231 that is generally symmetrical about a central axis (not shown) in front elevational view. Holder 230 has a constant thickness, as does holder 10, and has a pointed, first end 232 with a bore 234 and a arcuate, second end 236 with a substantially circular (in front elevational view) handle portion 238.

Figure 24:
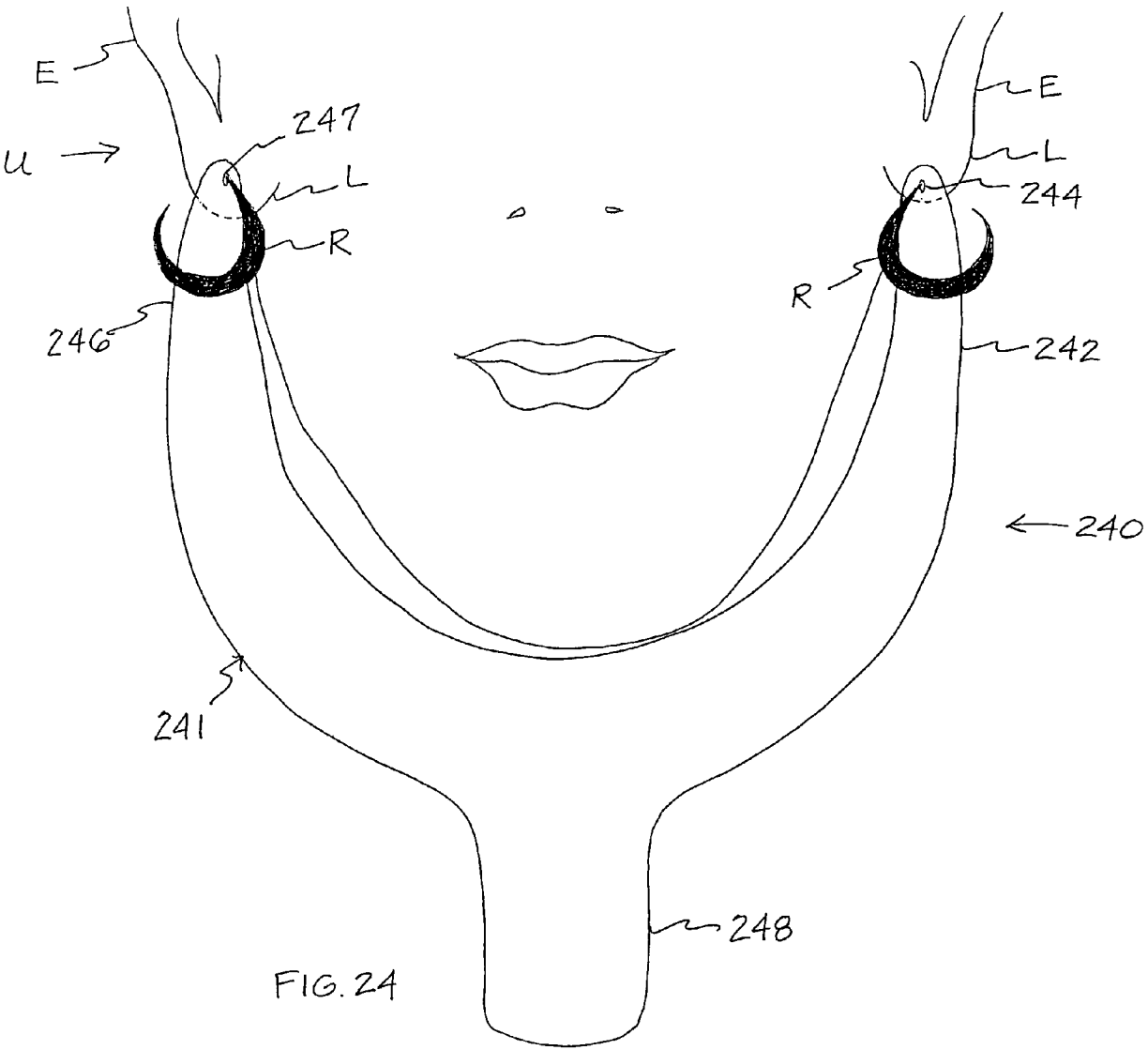
FIG. 24 is a front elevational view of yet another another embodiment of the present invention in which the holder has a "Y" shape and has earring orifaces at the end of each arm.

In FIG. 24, an earring holder 240 is depicted with a Y-shaped elongated, body 241 that is generally symmetrical about a central axis (not shown) in front elevational view. Holder 240 has a constant thickness, as does holder 10, and has a first arm 242 that has a pointed end with a bore 244 at the pointed end, and a second arm 246 that has a pointed end with a bore 247 that is substantially the same as bore 234. Holder 240 also has an integral handle portion 248 that is the base of the Y-shaped body 241. Holder 240 permits a user U "try-on" both pierced earrings R at the at each earlobe L of ears E at the same time using a front view of user U, instead of the side view as depicted in FIGS. 4 and 5.

In one embodiment, holder 240 is rigid, and thus a different size would be needed for the different widths of the faces of users. In a second, more preferred embodiment of holder 240, body 241 is comprised of a transparent plastic material that is flexible enough so that it can be rotated towards and away from the central axis, yet also is not resilient so that once the arms are positioned to a preferred amount of separation, the arms will tend to stay in that position.

Still further alternative embodiments exist and would be obvious to those skilled in the art, but which would be encompassed within the scope of the attached claims. Such further embodiments would include different lengths, a different overall shape and design, and different degrees of flexibility, different amounts and coverage of transparency over the body of the holder.

We claim:

1. A holder for the temporary positional display of an ornamental object having an attached mounting member, so that a user can see how the object will look when so positioned, the holder comprising:

an elongate, one piece body that has a thinner width than the length thereof, said body including a first end portion that is tapered, a mid portion that is integral with said tapered portion; and a second, end portion integral with said mid portion having a size such that it can be used as a handle by the user of the holder; and a bore located near an end of said tapered first end portion, said bore extending completely through said body, said bore having a diameter so as to be able to receive and hold in place the mounting member of the ornamental object, wherein said body is made of a transparent plastic material.

2. The holder as claimed in claim 1 wherein said holder is for a pierced earring to be worn through a pierced ear of a user for placement proximate to a potential purchaser's ear to simulate an attached earring so that the user can see how the earring will look when worn, the mounting member being a post of the pierced earring that extends through a hole in an earlobe of the user, wherein said body is made of a clear, transparent, rigid material and has substantially thinner width than the length thereof.

3. The holder as claimed in claim 2 wherein the bore is relatively small and has a large enough size such that a post of a pierced earring may be easily inserted through it, but still has a small enough size such that an earring post does not have very much play.

4. The holder as claimed in claim 2 wherein said material is lightweight and scratch resistant.

5. The holder as claimed in claim 1 wherein said body is of a thin, rigid, non brittle plastic that can be cleaned with soap and water.

6. The holder as claimed in claim 5 wherein said plastic is a methyl methacrylate polymer.

7. The holder as claimed in claim 1 wherein said body has a width at said tapered first end that is about one-fifth the width of said second end.

8. The holder as claimed in claim 7 wherein said body is stamped out of said material as a single, integral piece.

9. The holder as claimed in claim 1 wherein said body is symmetrical about a longitudinal axis.

10. The holder as claimed in claim 1 wherein said first end portion is tapered and said second end portion is broader.

11. The holder as claimed in claim 1 wherein said body is collinear in a front elevational view.

12. The holder as claimed in claim 1 wherein said body has an arcuate shape in a front elevational view.

13. The holder as claimed in claim 12 wherein said body has an "S" shape in a front elevational view.

14. The holder as claimed in claim 1 wherein said second end portion is pointed and has a bore located near an end of said tapered first end portion, said bore extending completely through said body, and said bore having a diameter so as to be able to receive a post of a pierce earring.

15. The holder as claimed in claim 1 wherein the thickness of said body is thinner at said first end portion than at said second end portion.

16. The holder as claimed in claim 1 wherein said body has a hang hole therethrough.

17. The holder as claimed in claim 1 wherein said body is made of a clear, transparent, rigid, non brittle, non fogging, thin, lightweight, scratch resistant plastic material.

18. A holder for a pierced earring to be worn through a pierced ear of a user for placement proximate to a potential purchaser's ear to simulate an attached earring so that the user can see how the earring will look when worn, the holder comprising:

an elongate, one piece, transparent plastic body that has a substantially thinner width than the length thereof, said body including a first end portion that is tapered, a mid portion that is integral with said tapered portion; and a second, end portion integral with said mid portion that is tapered, either said first or said second end being usable as a handle by the user of the earring holder;

a first bore located near an end of said tapered first end portion, said first bore extending completely through said body, said first bore having a diameter so as to be able to receive and hold in place a post of a pierced earring; and a second bore located near an end of said tapered second end portion, said second bore extending completely through said body, said second bore having a diameter so as to be able to receive and hold in place a post of a pierced earring.

19. A holder as claimed in claim 18 wherein said body has a hang hole therethrough.

20. A holder for a pierced earring to be worn through a pierced ear of a user for placement proximate to a potential purchaser's ear to simulate an attached earring so that the user can see how the earring will look when worn, the holder comprising:

an elongate, one piece, transparent plastic body that has a substantially thinner width than the length thereof, said body including a first end portion that is tapered, a mid portion that is integral with said tapered portion; and a second, end portion integral with said mid portion that is tapered, either said first or said second end being usable as a handle by the user of the earring holder;

a first bore located near an end of said tapered first end portion, said first bore extending completely through said body, said first bore having a diameter so as to be able to receive and hold in place a post of a pierced earring; and a second bore located near an end of said tapered second end portion, said second bore extending completely through said body, said second bore having a diameter so as to be able to receive and hold in place a post of a pierced earring; and a hang hole completely through said body.

* * * * *